US008322489B1

(12) United States Patent
Denison

(10) Patent No.: US 8,322,489 B1
(45) Date of Patent: Dec. 4, 2012

(54) AERIAL RESCUE DEVICE

(76) Inventor: Orville Douglas Denison, Monrovia, CA (US)

( * ) Notice: Subject to any disclaimer, the term of this patent is extended or adjusted under 35 U.S.C. 154(b) by 0 days.

(21) Appl. No.: 13/371,446

(22) Filed: Feb. 12, 2012

(51) Int. Cl.
*E06C 7/16* (2006.01)

(52) U.S. Cl. ..... 182/103; 182/101; 182/102

(58) Field of Classification Search ..... 182/101, 182/102, 103
See application file for complete search history.

(56) References Cited

U.S. PATENT DOCUMENTS

| | | | | | |
|---|---|---|---|---|---|
| 107,225 | A | | 9/1870 | Claflin | |
| 156,541 | A | * | 11/1874 | Fahringer et al. | 187/241 |
| 336,414 | A | * | 2/1886 | Kerr | 182/10 |
| 921,117 | A | * | 5/1909 | Jones | 182/103 |
| 2,198,071 | A | * | 4/1940 | Vespasiano | 182/103 |
| 2,312,833 | A | * | 3/1943 | Graham | 182/102 |
| 2,588,959 | A | * | 3/1952 | Campbell | 182/103 |
| 2,714,434 | A | | 10/1954 | Peterson | |
| 3,088,542 | A | * | 5/1963 | Johnson et al. | 182/48 |
| 3,666,054 | A | * | 5/1972 | Ellings et al. | 182/103 |
| 3,825,107 | A | * | 7/1974 | Cary et al. | 198/313 |
| 3,891,062 | A | | 6/1975 | Geneste | |
| 4,050,542 | A | * | 9/1977 | Wilson | 182/10 |
| 4,183,423 | A | * | 1/1980 | Lewis | 182/103 |
| 4,366,591 | A | * | 1/1983 | Zimmerman | 14/71.3 |
| 4,467,889 | A | * | 8/1984 | Maubach et al. | 182/103 |
| 4,491,196 | A | * | 1/1985 | Bocker | 187/243 |
| 4,550,806 | A | * | 11/1985 | Bocker | 187/246 |
| 4,800,988 | A | * | 1/1989 | Dunmore | 182/103 |
| 4,930,599 | A | * | 6/1990 | Simms, Sr. | 182/103 |
| 5,086,908 | A | * | 2/1992 | Gladish et al. | 198/468.6 |
| 5,145,031 | A | | 9/1992 | Sprunger | |
| 6,095,284 | A | | 8/2000 | Smith | |
| 7,308,968 | B2 | * | 12/2007 | Denison | 182/42 |
| 7,370,725 | B1 | | 5/2008 | Dornfeld | |
| 7,424,932 | B1 | * | 9/2008 | Murphy | 182/103 |
| 7,686,566 | B1 | * | 3/2010 | Murphy | 414/800 |
| 7,900,745 | B1 | * | 3/2011 | Tindal | 182/103 |
| 8,074,767 | B1 | * | 12/2011 | Denison | 182/42 |
| 2002/0043426 | A1 | * | 4/2002 | Bruneau et al. | 182/103 |
| 2007/0267250 | A1 | | 11/2007 | Wolff | |

* cited by examiner

*Primary Examiner* — Alvin Chin Shue
*Assistant Examiner* — Colleen M Chavchavadze
(74) *Attorney, Agent, or Firm* — Louis Ventre, Jr.

(57) ABSTRACT

An aerial rescue device is a powered platform that quickly elevates the fireman to height, or powers the secure descent of a rescued person. A powered carriage rides between two extensible booms. Two rungs secured to the carriage enable a fireman to stand on one and hold onto the other. The two booms have rails within. The rails guide trolleys secured to the ends of the two rungs. The carriage is moved by two cables. Each cable is connected at one end to the carriage and at the other end to two winches. These winches are computer controlled to enable the carriage to ride up and down while the booms are being extended. Preferably, there are also rotatable boom segments at the top of the booms.

9 Claims, 6 Drawing Sheets

AERIAL RESCUE DEVICE

TECHNICAL FIELD

In the field of fire escapes, ladders, or scaffolds, a device is mounted on a vehicle for transport from a first location to a second location, the device having extensible nested booms that may be lowered for transportation and raised to an elevated position after transportation, and the device having a work platform movable up and down along the extensible nested booms using a pair of operationally interconnected winches.

BACKGROUND ART

This invention is an improvement over U.S. Pat. No. 7,308,968 (the '968 patent) for a transportable rescue conveyer in that it provides unique powered aerial ladder mechanism that extends the stiles of the ladder to reach a building, ship or oil-drilling platform and also moves the rungs to raise and lower the fireman, a person rescued, and any load the fireman may need to raise or lower with him. Unlike the '968 patent, this improvement provides a powered carriage for a fire and rescue truck that eliminates a significant amount of weight due to the absence of powered rungs and the rung storage needed for operability. Less weight means that two parallel pairs of booms can be used to enable two powered carriages to independently move up and down the booms.

A telescopic lift is taught in U.S. Pat. No. 3,891,062 B1 (the '062 patent), which is used for construction works. It is a mobile lift made up of a rectilinear guide adjustably held in upward inclined position by a support having a base of which the end is wheel-mounted so that the lift may be displaced. A load carrier is movably mounted on a guide and a cable, of which one end is secured on the carrier and the other winds around a mechanical winch after having wound around a pulley, allows displacement of the carrier on the guide.

The present invention is distinctive over the '062 patent in using two cables one mounted to the top end of the carriage and one mounted to the bottom end. The dual cables add safety in the event a single cable breaks and enables powered transit of the carriage in both directions while the booms are being extended or contracted. This feature is enabled by the provision of dual winches that are computer controlled to rotate in any direction as required to accommodate carriage movement while extending or contracting the extensible booms. The present invention is further distinctive with the inclusion of a tilting boom at the elevated end of the booms. The tilting boom enables the carriage to adjust to horizontal for loading, unloading and working at height. The tilting boom also permits adjustment so that the boom can lean on a wall.

SUMMARY OF INVENTION

An aerial rescue device is similar to a ladder on a fire truck, except that it is a powered platform that quickly elevates the fireman to height, or powers the secure descent of a rescued person. A powered carriage rides between two booms. Two rungs secured to the carriage enable a fireman to stand on one and hold onto the other. Two booms have rails within. The rails guide trolleys secured to the ends of the two rungs. The carriage is moved by two cables. Each cable is connected at one end to the carriage and at the other end to two winches. These winches are computer controlled to enable the carriage to ride up and down while the booms are being extended. Preferably, there are also rotatable boom segments at the top of the booms so that the carriage can be rotated to horizontal once at the top of the booms; side hand rails on the carriage to permit secured operations from the carriage; a body bag attachable to the two rungs for secure descent of a rescued person; an oxygen source and a cover that can be used instead of a body bag.

Technical Problem

Fire and rescue ladders are powered to raise and lower a fireman or rescued individual are complex mechanical structures. Because of the significant number of moving rungs in a boom extensible system, powered aerial ladders are often heavy and thus have operational restrictions to accommodate the weight. Because there needs to be a complex rung storage system to accommodate the rungs involved when using extensible booms, the speed of the rungs can be slower than desired. The complexity of the system offers both manufacturing complications, servicing expertise and detailed maintenance routines. The weight of existing powered aerial ladders make it impossible to enable fire fighters to be going up one side while personnel are going down the second unit.

Solution to Problem

The solution to the problem is an aerial rescue device that is mechanically simplified, faster, safer to operate and maintain, lighter in weight and very easy to manufacture. The aerial rescue device has no need for rung storage and can be operated with two winches that are computer controlled to enable carriage movement in any direction while nested booms are extended or contracted. Its light weight permits 2 pairs of booms to be used side by side to allow two carts to be moved up and down independently. The tipping top end of the booms also enables the carriage to be moved to horizontal to facilitate firefighting and rescue operations.

Advantageous Effects of Invention

The aerial rescue device is complete system that would be retrofitable to existing aerial fire trucks or retrofitted onto ships for ship to ship rescue, sea to ship rescue or oil derrick to ship rescue.

The aerial rescue device could be attached to a flat bed trailer, low bed trailer to provide a system that will not require physical effort to take gear up or victims down from a disaster area.

The aerial rescue device could be mounted onto the top of a vehicle and deployed so that personnel in war zones could quickly be elevated over a wall, into a multi-story building or to robotically defuse bombs without endangering personnel.

The aerial rescue device has a tipping top end of the booms that rotates to the horizontal. This is so that personnel do not have to disembark from the carriage at the top while it is on the incline, the reverse would be true of the loading of the cart, which can be done in the horizontal position.

BRIEF DESCRIPTION OF DRAWINGS

The drawings illustrate preferred embodiments of the method of the invention.

DESCRIPTION OF EMBODIMENTS

Figure 2:
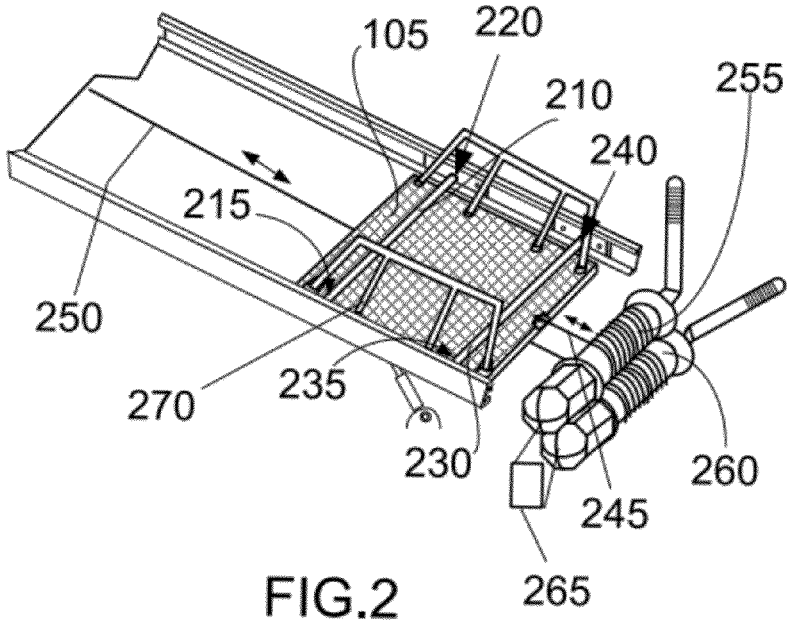
FIG. 2 is a perspective view of the base portion of a preferred embodiment of the aerial rescue device showing the carriage and winches.

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention. The reference numbers in the drawings are used consistently throughout. New reference numbers in FIG. 2 are given the 200 series numbers. Similarly, new reference numbers in each succeeding drawing are given a corresponding series number beginning with the figure number.

Figure 1:
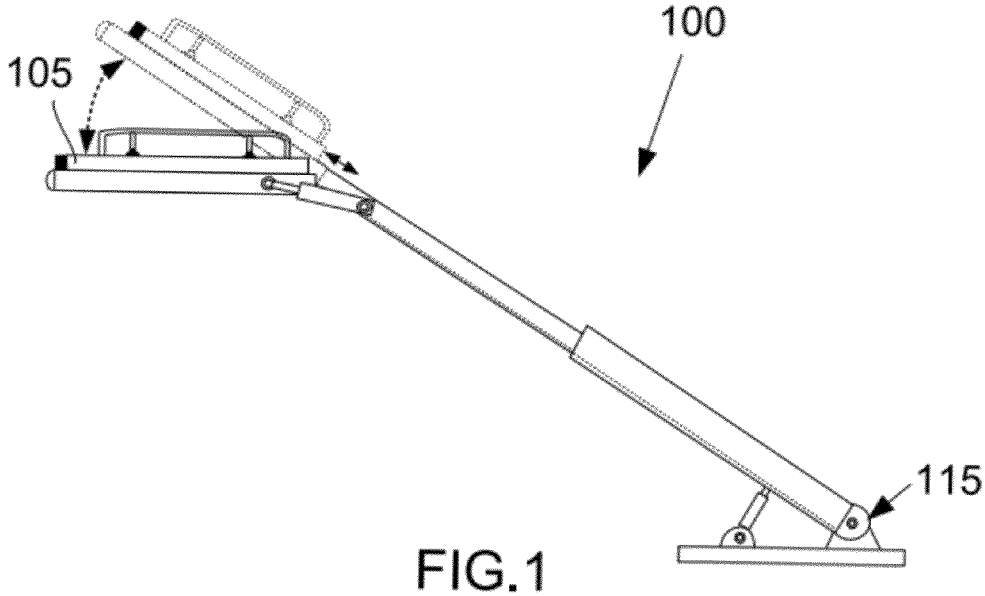
FIG. 1 is a side elevation view of a preferred embodiment of an aerial rescue device with a basic flat carriage.

FIG. 1 illustrates a side elevation view of an aerial rescue device (100) that is intended for mounting on a vehicle, that is for example, a fire truck. The aerial rescue device (100) preferably uses hydraulic units to power movement of the booms.

Figure 7:
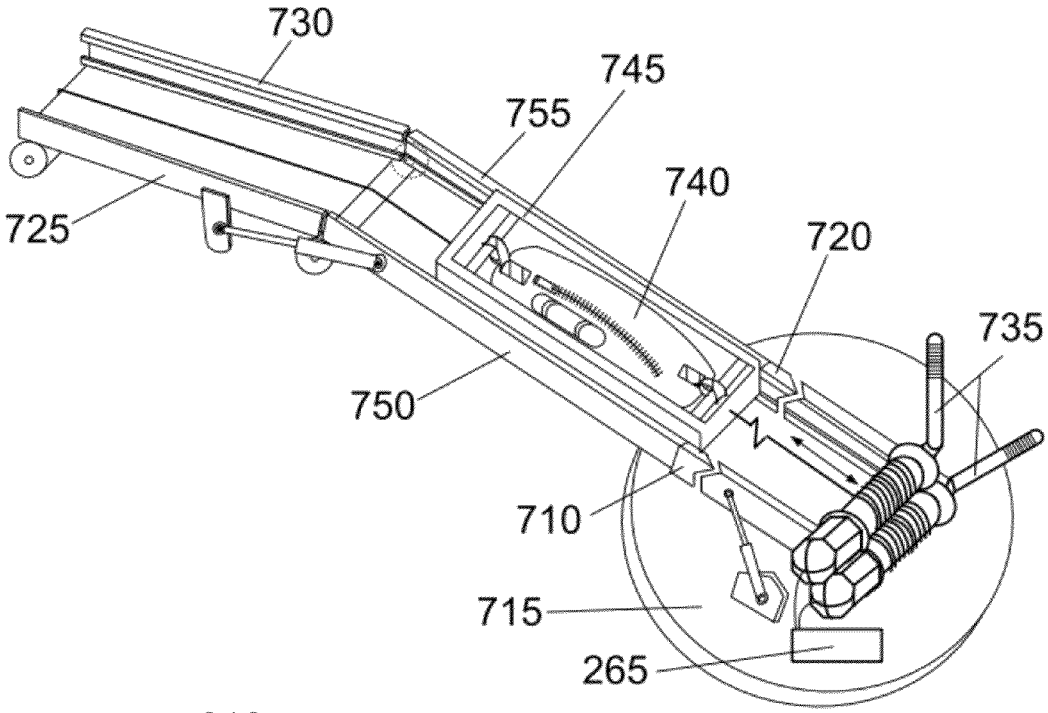
FIG. 7 is a perspective view of an alternative embodiment of an aerial rescue device with a box-like carriage.

FIG. 7 shows an alternative aerial rescue device having a box-like carriage (745) shown without the side hand rails (270) for clarity. FIG. 1 and FIG. 7 illustrate a variation of a fire truck ladder used to fight fires and rescue people at an elevation above the ground. The FIG. 1 and FIG. 7 embodiments illustrate a dual boom system on a rotatable base (715). The system powers the elevation of a fireman and equipment up then exterior of a building, or controls the descent of a carriage carrying a fireman or rescued person.

Because the boom structure is relatively light, it may be used with two pairs of booms adjacent to each other so that up and down powered transport can be simultaneously accommodated. These units could be operating side by side, attached at the center, swiveling about the common base. Thus, the rail system may be engineered to have two carriages running side by side, one could travel up while the second carriage travels down. This is desirable to enable fire fighters to be going up one unit while personnel are going down the second unit. Alternatively, either carriage could run up or down simultaneously with the second carriage used to maximize bringing personnel and gear up or down from or to the site of the rescue.

The aerial rescue device (100) includes: a carriage (105), a top-rung (210); a bottom-rung (230); a plurality of booms with at least a left-boom (710) and a right-boom (720); a rail (420) within each boom; a plurality of trolleys (810); a first cable (245); a second cable (250); a first winch (255); and a second winch (260).

Optionally, preferred embodiments also contain: rotatable boom segments at the top of the booms so that the carriage (105) can be leveled to horizontal once at the top; side hand rails (270) on the carriage (105) to permit secured operations from the carriage (105); a body bag (740) to permit secure descent of a rescued person; an oxygen source (920); and a cover (910) that can be used instead of a body bag (740). This means that a pulley for the cable at the top would be supplemented with another pulley on the carriage (105) near the end of the platform-top-edge (610) to pull the carriage (105) all the way up and to control the descent from the horizontal position.

Example 1

In this example, the grooved track extends the full length of the extended booms. About eight feet from the end there is a break line across the entire platform and rails. The end section can be lowered down or rotated to horizontal while the main section remains on an angle. The carriage (105) would be pulled to the very end where it would come to a hard stop and be held in that position with the tension of the lower and upper cables, to with, the first cable (245) and the second cable (250), respectively. Once the carriage (105) has traveled across the break in the rails (420), it can be lowered without consequence. The angle of the carriage (105) is controlled by two hydraulic units connected to a bell crank on the bottom side of the upper or last sub-boom. There is preferably one hydraulic unit on either side to distribute the tilting force evenly. Once the carriage (105) has been loaded or unloaded, it is pushed up to parallel the position of the tilted main section so the carriage (105) can travel down and across the break line in the side booms.

The carriage (105) is essentially a platform that is pulled up and down the booms by two counter-rotating winches. The carriage (105) is a cart or rescue vehicle that travels on a rail system that contains the vehicle. A box-like carriage (745) as shown in FIG. 7 is preferable because it can provide additional containment support for persons, pets or objects raised or lowered. The platform preferably has a rectangular shape. It has a length, or a long dimension of the platform (620), defined by the distance between a platform-top-edge (610) and a platform-bottom-edge (615). It has width, or a short dimension of the platform (635), defined by the distance between a platform-right-side (625) and a platform-left-side (630). The width is shorter than the long dimension of the platform (620).

A top-rung (210) is mounted to the platform, preferably near the platform-top-edge (610), that is, immediately below the platform-top-edge (610). The top rung (210) enables a fireman to hold on while being transported up or down the booms. As importantly, the top rung (210) has trolleys attached at its ends and this enables movement of the platform up and down between the booms. The top-rung (210) is defined by a top-rung-left-side (215) and a top-rung-right-side (220). Thus, the top-rung-left-side (215) extends beyond the platform-left-side (630) and the top-rung-right-side (220) extends beyond the platform-right-side (625).

A bottom-rung (230) is mounted to the platform above the platform-bottom-edge (615), that is, immediately above the platform-bottom-edge (615). The platform-bottom-edge (615) enables a fireman to stand within the platform while being transported up or down the booms. The bottom-rung (230) is defined by a bottom-rung-left-side (235) and a bottom-rung-right-side (240). Thus, the bottom-rung-left-side (235) extends beyond the platform-left-side (630) and the bottom-rung-right-side (240) extends beyond the platform-right-side (625). When the carriage (105) has side walls as shown in FIG. 7, the two rungs are preferably mounted or attached to the carriage (105) by penetrating the sidewalls of the carriage (105).

Since there are preferably two rungs and four grooved wheel sets or trolleys that travel in compatible booms, the overall weight is minimized compared to existing aerial ladder trucks, which have rungs positioned on 14" centers for easy climbing up or down. The aerial rescue device (100) does not require climbing, rather only a place for feet and hands to be positioned while riding up or down to the site of a fire or rescue for any other reason. Persons would travel up or down inside the carriage (105) so there is no exposure of toes or hands to any support structure and no possibility to be injured from friction burns.

The carriage size and shape is preferably engineered to accommodate large persons, for example, up to 500 pounds. So that a fireman can comfortably stand within the carriage (105) and so that it can accommodate a rescued person, the long dimension of the platform (620) is preferably between about 5 feet and 8 feet. Alternatively, the distance between the top-rung (210) and the bottom-rung (230) is preferably between about 5 feet and 7 feet.

Figure 3:
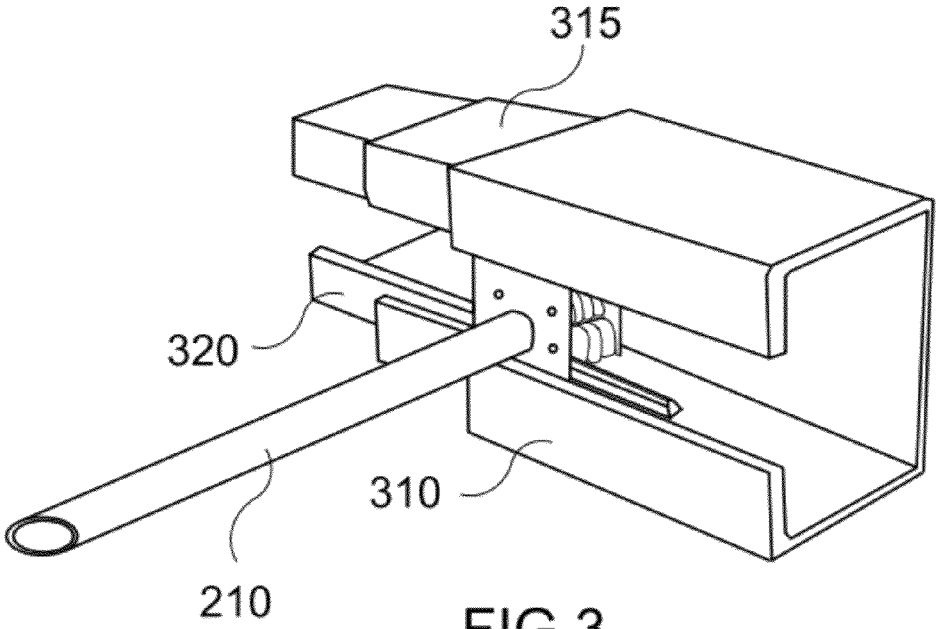
FIG. 3 is a perspective view of portions of a rung, trolley, rails and three nested booms.
Figure 4:
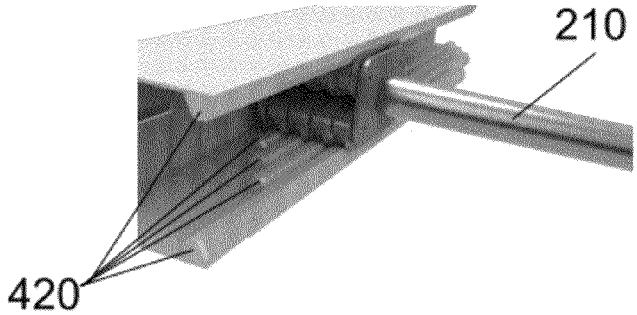
FIG. 4 is an alternate perspective view of a rung, trolley, rail and boom interconnection.

The plurality of booms includes a left-boom (710), which itself includes a nested extensible left-sub-boom (750). The plurality of booms further includes a right-boom (720) comprising a nested extensible right-sub-boom (755). Additional nested sub-booms may be used to increase the length of the left boom (710) and the right boom (720). FIG. 3 shows a perspective of three nested booms with a base boom (310); a first nested extensible right-sub-boom (315) and a second nested extensible right-sub-boom (320).

The left-sub-boom (750) and the right-sub-boom (755) extend and contract in unison. Computer controls are provided to ensure this operability.

The anticipated operation of the booms is to raise and lower a person or object at the side of a building. Thus, typically, the plurality of booms is oriented to extend to a vertical height above a base. However, the booms might be lowered down cliff or to a lower elevation and used in that manner.

The rail (420) is located within each boom of the plurality of booms. This is best 10 illustrated in FIG. 5, which shows an end view of four nested booms: an alternative base boom (510); an alternative first nested sub-boom (515); an alternative second nested sub-boom (520); and an alternative third nested sub-boom (525). Preferably, the carriage (105) would travel within the confines of the top and bottom of the rail system attached to the booms when the booms are extended or retracted.

The plurality of trolleys (810), preferably two trolleys for each rung, are mounted two to the top-rung (210) and two to the bottom-rung (230). Thus, one trolley is on each end of the top-rung (210) and one trolley is on each end of the bottom-rung (230).

Figure 5:
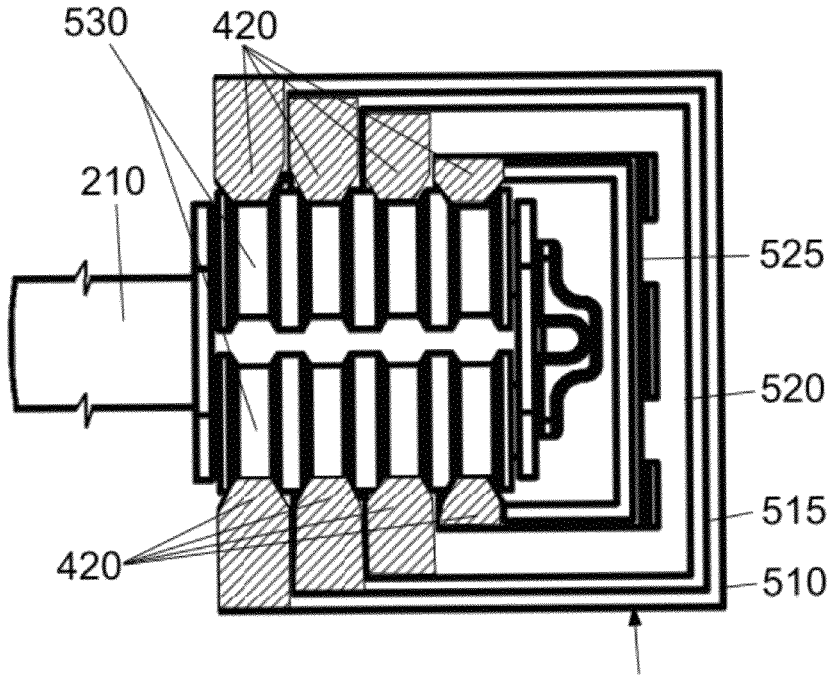
FIG. 5 is a side elevation view of a four nested booms, a trolley and rails.
Figure 6:
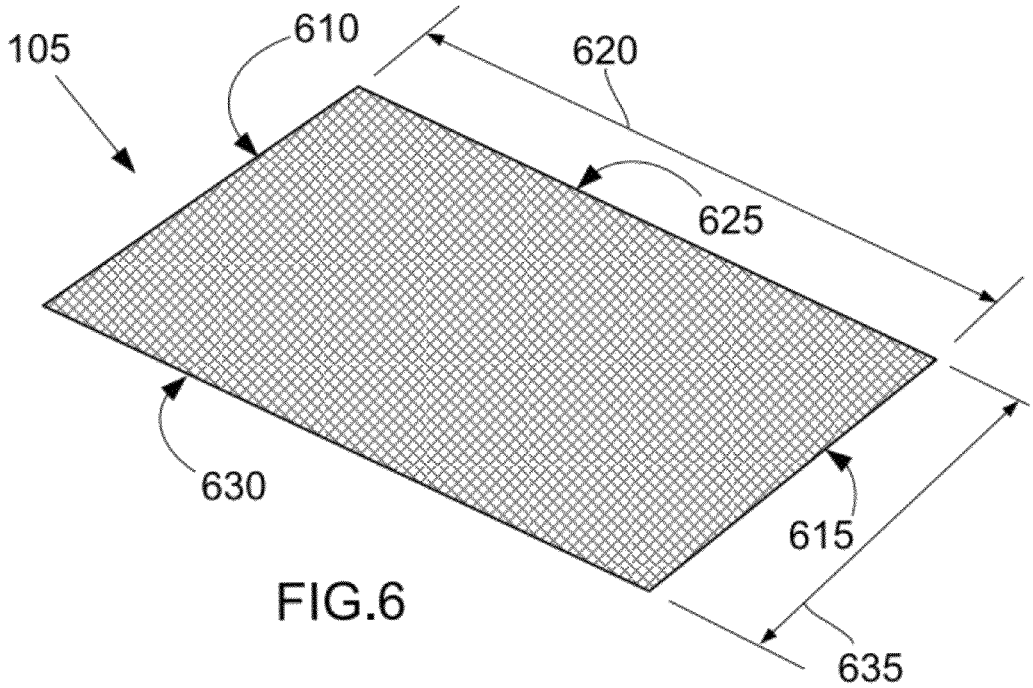
FIG. 6 is a perspective view of a carriage.
Figure 8:
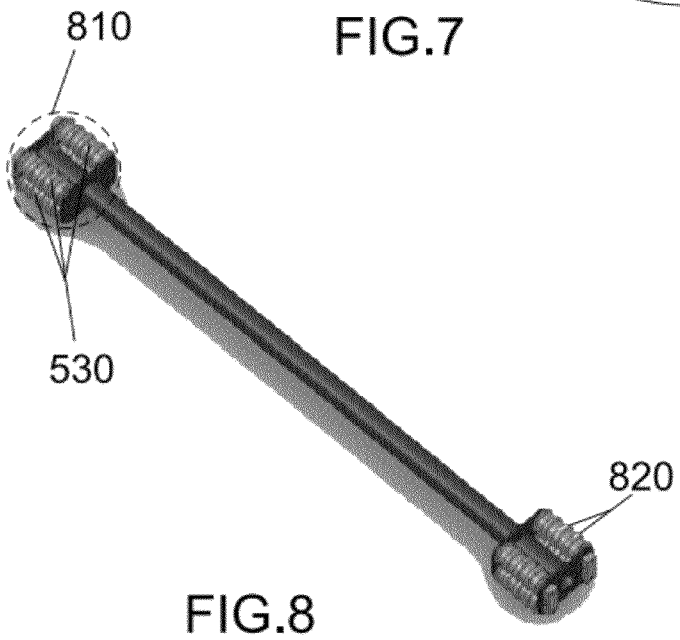
FIG. 8 is a perspective a rung with two trolleys.
Figure 9:
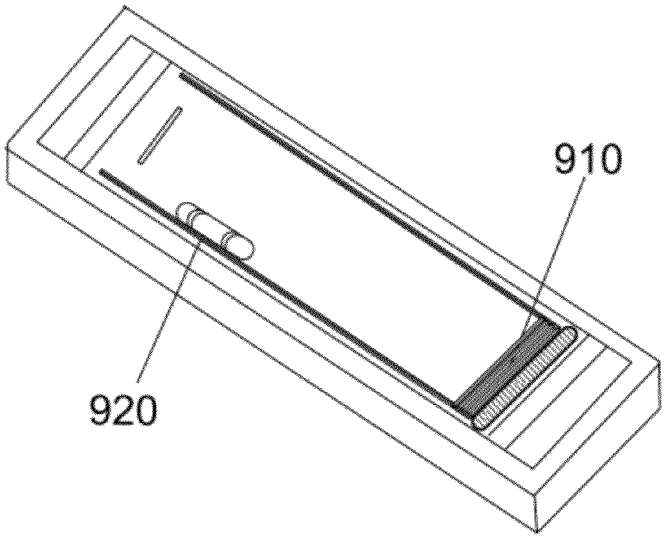
FIG. 9 is a perspective of a carriage with a cover that rolls up.

Each trolley in the plurality of trolleys (810) includes a plurality of roller assemblies (530). Preferably there are four roller assemblies as shown in FIG. 8. The side elevation view of a four nested booms in FIG. 5 shows a close-up of two of four roller assemblies (530).

Each roller assembly (530) in the plurality of roller assemblies includes grooved rims (820) that straddle the rail (420) within each boom. The grooved rims (820) of the roller assemblies (530) maintain each rung in position between the booms and enable slidable movement of the rungs, and thus the platform to which the rungs are affixed, up and down the booms.

A first cable (245) is mounted to the platform near the platform-bottom-edge (615). A second cable (250) is mounted to the platform near the platform-top-edge (610). These cables are typically pulled from opposite directions by winches, except perhaps when the booms are being extended or contracted faster than the platform is being pulled. The term cable may include a rope of heavy steel or fiber or a chain.

Thus, there is a first winch (255) upon which the first cable (245) is rotatably secured and a second winch (260) upon which the second cable (250) is rotatably secured. The first winch (255) and the second winch (260) are computer controlled. A computer control (265) is required to enable the winches to move in opposite directions or in the same direction when the movement of the booms so require. Thus, the winches are operationally connected together to so that the first cable (245) and the second cable remain taut while the platform moves up and down the plurality of booms and while the left-sub-boom and the right-sub-boom extend and contract. A hand brake (735) on each winch preferably permits manual override of winch operation during emergencies.

Preferably, the first winch (255) and the second winch (260) are located at the base (115) of the plurality of booms. They may however be located at differing positions along the booms.

Figure 10:
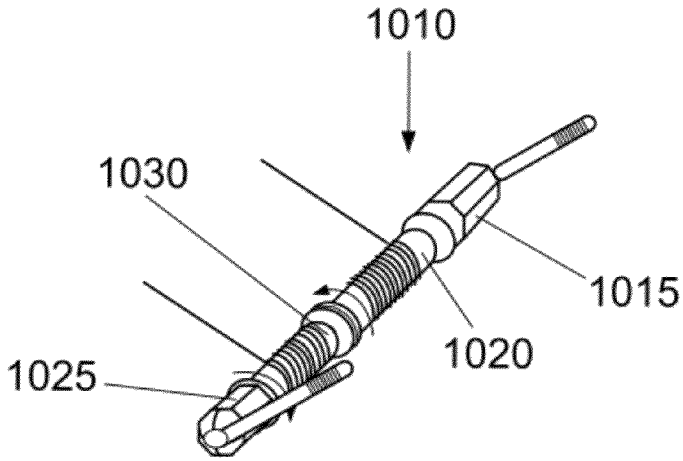
FIG. 10 is a perspective of a linearly aligned pair of winches.

Additionally, in an alternative embodiment, the two separate winches are linearly aligned along a split drive shaft or power spool, which is split and supported at the center to enable opposite rotation and motors on either side of the split drive shaft may be used to power the independent rotation of the either side of the split drive shaft. A linearly aligned pair of winches is shown in FIG. 10. Thus, a single linear winch system (1010) at the base (115) may be used. For example, this linear system is a first motor (1015) and first power spool (1020) on the right controlling the pull of the cable from the downside of the cart and a second motor (1025) and second power spool (1030) on the left controlling the cable that runs under the carriage (105) up to an upper end pulley and down to the upper part of the carriage. The separation of the two power spools that are linearly aligned permits the motor for the pulling system to roll at a different rate or direction from the second spool on the right as controlled by the computer control (265). The two linear-aligned power spools can spool in opposite directions to take up the slack in the cables connected to the carriage (105).

Figure 11:
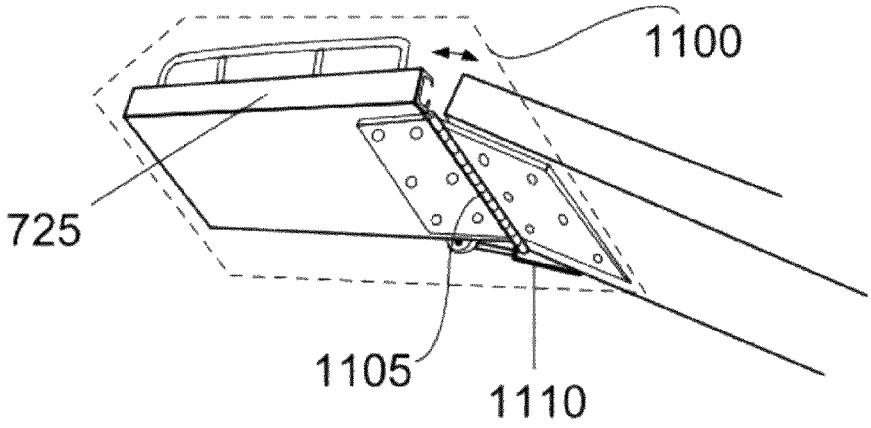
FIG. 11 is a perspective showing a hinge at a tilting to end of a preferred embodiment of the aerial rescue device.

The aerial rescue device (100) preferably includes a tilting top end (1100), as shown within the dashed enclosure in FIG. 11. FIG. 11 also shows a hinge (1105) that permits both rotational movement of the tilting top end (1100). One or more hydraulic units (1110) control the tilt angle.

In reference to FIG. 7, a first rotatable boom segment (725) is at the tip of the nested extensible left-sub-boom (750), and a second rotatable boom segment (730) is at the tip of the nested extensible right-sub-boom (755). The first rotatable boom segment (725) and the second rotatable boom segment (730) are operationally connected to rotate in unison to a level position at the end of the plurality of booms. Preferably, the computer control (265) ensures this operational capability. This tilting top end (1100) is at least as long as the carriage (105) so that the carriage can be safely leveled. Thus, the first rotatable boom segment (725) and the second rotatable boom segment (730) have a length greater than the long dimension of the platform (620).

The side hand rails (270) are attached to the platform-left-side (630) and to the platform-right-side (625). Such rails are preferably of a size and height to enable a person to safely stand on the carriage (105) when it is raised to the top of the booms. The side hand rails (270) preferably have structural support for a minimum of 500 pounds at 45 degrees at the extended tip of 100 feet.

The body bag (740) is shown in FIG. 7. It is attachable to the top-rung (210) and to the bottom-rung (230) to enable a rescued person, who is either conscious or unconscious, to safely and securely ride down the booms when in the body bag (740). The body bag (740) preferably has a zipper to enable fast closure. This optional component would be useful in conveying a disabled or unconscious person.

In some embodiments, the cover (910) is attached to the platform, which will be less confining than the body bag (740) and more accommodating to animals or other objects. For example, Pets could be placed into the carriage (105), then a roll-up cover is fixed in place to contain the pet during descent. The cover (910) is preferably a roll-up cover that is configured to be pulled to enclose, protect and secure a person or object to the platform. Preferably, the cover (910) is affixed at the bottom of the carriage (105) and has a slidable attachment along the sides of the carriage (105). Whether a body bag (740) or a cover (910), it should be operable in a water and heat environment to protect a person to be conveyed on the carriage (105).

An oxygen source (920) is preferably available to a person in the body bag (740) or under the cover (910) to facilitate breathing of the person.

In alternative embodiments, a telescoping water channel is included into the boom structure. However it is expected that a fireman would attach a water nozzle to a fixture attachable to the rungs so that the carriage 9105) could pull the water cannon up to the site of a fire. Alternatively, there could be a water cannon attached to the upper landing, which could be directionally controlled by robotic or hand held remote control. This would eliminate the need for a person to manually control the water cannon and that would eliminate the exposure of a fire fighter to the elements. At any time the water cannon could be attached or removed from the upper platform in order to utilize the system for human rescue.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the fire and rescue industry.

What is claimed is:

1. An aerial rescue device for mounting on a truck comprising:

a carriage comprising:

a platform, the platform comprising an area defined by:

a platform-top-edge;

a platform-bottom-edge;

said platform-top-edge and platform-bottom-edge together define a long dimension of the platform;

a platform-right-side;

a platform-left-side; and said platform-right-side and platform-left-side together define a short dimension of the platform that is shorter than the long dimension of the platform;

a top-rung mounted to the platform below the platform-top-edge;

the top-rung defined by a top-rung-left-side and a top-rung-right-side;

the top-rung-left-side extending beyond the platform-left-side;

the top-rung-right-side extending beyond the platform-right-side;

a bottom-rung mounted to the platform above the platform-bottom-edge;

the bottom-rung defined by a bottom-rung-left-side and a bottom-rung-right-side;

the bottom-rung-left-side extending beyond the platform-left-side;

the bottom-rung-right-side extending beyond the platform-right-side;

a plurality of booms comprising:

a left-boom comprising a nested extensible left-sub-boom;

a right-boom comprising a nested extensible right-sub-boom;

said nested extensible left-sub-boom and said nested extensible right-sub-boom extend and contract in unison;

a rail within each boom of the plurality of booms;

a plurality of trolleys mounted to the top-rung and the bottom-rung;

each trolley in the plurality of trolleys comprises a plurality of roller assemblies;

each roller assembly in the plurality of roller assemblies comprises grooved rims that straddle the rail within each boom;

a first cable mounted to the platform near the platform-bottom-edge;

a second cable mounted to the platform near the platform-top-edge;

a first winch upon which the first cable is rotatably secured;

a second winch upon which the second cable is rotatably secured; and the first winch and the second winch are operationally connected together to so that the first cable and the second cable remain taut while the platform moves up and down the plurality of booms and while the nested extensible left-sub-boom and the nested extensible right-sub-boom extend and contract.

2. The aerial rescue device of claim 1, further comprising:

a first rotatable boom segment at a tip of the nested extensible left-sub-boom;

a second rotatable boom segment at a tip of the nested extensible right-sub-boom;

the first rotatable boom segment and the second rotatable boom segment are operationally connected to rotate in unison to a level position; and the first rotatable boom segment and the second rotatable boom segment have a length greater than the long dimension of the platform.

3. The aerial rescue device of claim 1, further comprising side hand rails attached to the platform-left-side and to the platform-right-side.

4. The aerial rescue device of claim 1, further comprising a body bag that is attachable to the top-rung and to the bottom-rung.

5. The aerial rescue device of claim 1, further comprising:

a cover attached to the platform, said cover configured to be pulled to enclose and secure a person to the platform; and an oxygen source under said cover to facilitate breathing of the person.

6. The aerial rescue device of claim 1, wherein the long dimension of the platform is between about 5 feet and 8 feet.

7. The aerial rescue device of claim 1, wherein a distance between the top-rung and the bottom-rung is between about 5 feet and 7 feet.

8. The aerial rescue device of claim 1:

wherein the plurality of booms is oriented to extend to a vertical height above a base; and wherein the first winch and the second winch are located at the base of the plurality of booms.

9. The aerial rescue device of claim 1, wherein the first winch and the second winch are linearly aligned along a split drive shaft supported at its center to enable opposite rotation.

* * * * *